United States Patent [19]

Wallman

[11] Patent Number: 5,036,991

[45] Date of Patent: Aug. 6, 1991

[54] TAMPER EVIDENT-CAP FOR CONTAINERS

[75] Inventor: Irwin Wallman, Shelburne, Vt.

[73] Assignee: Cap Snap Co., San Jose, Calif.

[21] Appl. No.: 590,954

[22] Filed: Sep. 28, 1990

[51] Int. Cl.[5] ..... B65D 41/48

[52] U.S. Cl. ..... 215/256; 215/305

[58] Field of Search ..... 215/256, 321, 320, 305, 215/235, 344

[56] References Cited

U.S. PATENT DOCUMENTS

| | | | |
|---|---|---|---|
| 2,894,654 | 7/1959 | Löhrer | 215/235 |
| 3,204,799 | 9/1965 | Hunter . | |
| 3,338,446 | 8/1967 | Faulstich . | |
| 4,037,748 | 7/1977 | Stubbs . | |
| 4,166,552 | 9/1979 | Faulstich . | |
| 4,202,455 | 5/1980 | Faulstich . | |
| 4,209,102 | 6/1980 | Dunn et al. | 215/344 |
| 4,484,687 | 11/1984 | Bullock . | |
| 4,496,066 | 1/1985 | Bullock . | |
| 4,566,601 | 1/1986 | Kuenzig | 215/256 |
| 4,625,898 | 12/1986 | Hazard | 215/235 |
| 4,678,094 | 7/1987 | Bullock | 215/256 |
| 4,699,287 | 10/1987 | Bullock . | |
| 4,903,849 | 2/1990 | Wallman . | |
| 4,966,292 | 10/1990 | Marino | 215/256 |

FOREIGN PATENT DOCUMENTS

| | | | |
|---|---|---|---|
| 1289508 | 9/1972 | United Kingdom | 215/344 |

*Primary Examiner*—Stephen Marcus
*Assistant Examiner*—Paul Schwarz
*Attorney, Agent, or Firm*—Julian Caplan

[57] ABSTRACT

A push on cap for engaging a container neck is formed with inturned thickened flanges on its inner surface which cooperate with matching grooves in the container neck to retain the cap in place when the skirt is intact. A circumferential groove is formed in the skirt intermediate the inturned thickened flanges joined with a second groove extending to the bottom edge of the skirt. A tab projecting beyond the skirt is gripped and pulled causing the skirt to tear upward and then circumferentially thereby removing the lower thickened flange and permitting the top of the cap to be removed and reclosed. A rigid circumferential flange on the exterior of the skirt is spaced above the level of the uppermost inturned thickened flange and below the top of the cap has an angled gusset below the flange to prevent removing the cap by prying upwards with a fingernail prior to removing the tear skirt. The addition of the rigid circular flange and gusset and the uppermost thickened flange do not restrict the cap from expanding when pressed over the neck of the container due to the thin wall formation of the circumferential skirt of the cap.

6 Claims, 2 Drawing Sheets

TAMPER EVIDENT-CAP FOR CONTAINERS

BACKGROUND OF THE INVENTION

1. Technical Field

This invention relates to tamper-proof caps for containers, such as blow molded plastic jugs which are widely used in the dairy industry for the expendible packaging of dairy products, such as milk.

2. Description of the Prior Art

Prior caps of this type may be seen in U.S. Pat. Nos. 3,338,446 of August, 1967 to Faulstich, 3,204,799 of September, 1965 to Hunter, 4,037,748 of July, 1977 to Stubbs, 4,166,552 of September, 1979 to Faulstich, 4,202,455 of May, 1980 to Faulstich, 4,484,687 of November, 1984 to Bullock, 4,496,066 of January, 1985 to Bullock, 4,566,601 of January, 1986 to Kunzig, 4,678,094 of July, 1987 to Bullock, 4,699,287 of October, 1987 to Bullock, and 4,903,849 of February, 1990 to Wallman.

It will be seen that the prior art relating to press on caps generally use a flexible peripheral flange at the top of the cap that allows the top section of the cap to be removed only after the lower circumferential portion of the skirt has been removed. Prior to removing the lower circumferential portion of the skirt, the typical flange will flex upwardly when a user attempts to remove the closure as in attempting to tamper with the contents of the container.

In the present invention, the rigid circular flange with its angled gusset therebelow formed on the thin walled circumferential skirt of the cap immediately above the uppermost internal thickened flange not only permits the efficient press on capabilities when the cap is installed on a neck of a container, but resists attempts to remove the cap without removing the tear portion of the circumferential skirt.

Additionally, it provides a rigid finger hold which enables the upper portion of the cap remaining after the lower circumferential tear skirt has been removed to be readily grasped and lifted upwardly and of equal importance it provides a practical finger hold when the upper portion of the cap is replaced on the neck of the container where it will relocate in sealing relation to the container.

SUMMARY OF THE INVENTION

A cap for a container neck has a central thin walled portion extending into an annular thickened portion from which a thin walled circumferential skirt depends. A pair of vertically spaced internal thickened flanges or bands are formed on the inner surface of the thin walled circumferential skirt defining annular fastening configurations and are separated by a circumferential groove defining an annular area of weakness which communicates with a secondary groove extending to the lower edge of the thin walled circumferential skirt at a point adjacent a depending tab formed thereon. A rigid circular flange is positioned on the exterior of the thin walled circumferential skirt spaced downwardly from the annular thickened portion of the top of the cap and immediately above the uppermost internal thickened flange thereof, a sealing flange depends from the annular thickened portion of the top of the cap adjacent the central thin walled portion thereof. The tamper-evident cap is engageable on the neck of a container, such as a blow molded jug having an appropriate finish, including an inturned flange at its upper end and at least a pair of inturned annular grooves on its exterior which will register with the upper surfaces of the pair of vertically spaced internal thickened flanges in the thin walled circumferential skirt of the cap when the cap is pressed thereon.

DESCRIPTION OF THE PREFERRED EMBODIMENT

Figure 2:
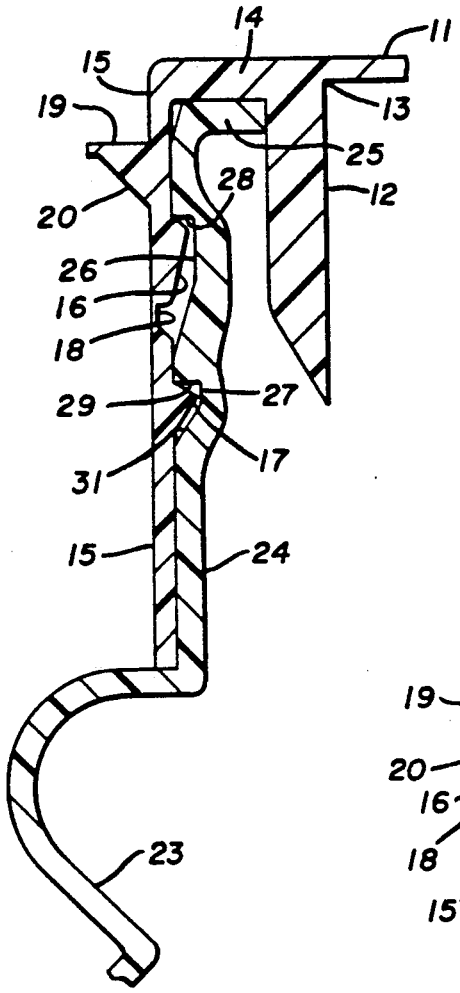
FIG. 2 is an enlarged vertical section through a portion of a container neck and a portion of the tamper-evident cap positioned thereon on line 2—2 of FIG. 1.
Figure 1:
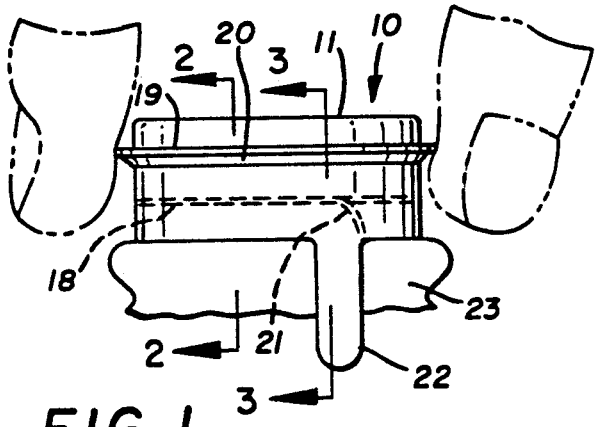
FIG. 1 is a side elevation of the tamper-evident cap on the upper portion of a broken away representation of a container, broken lines illustrate fingers engaging the cap and, a circumferential annular groove therein and a secondary groove extending downwardly therefrom are also shown.
Figure 4:
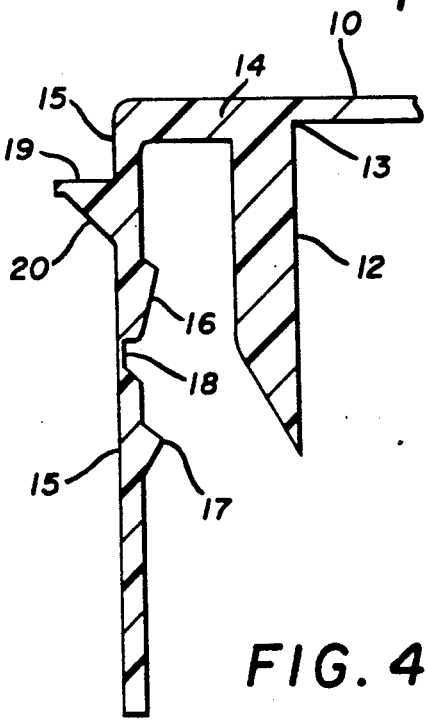
FIG. 4 is an enlarged section of the tamper-evident cap of FIGS. 2 and 3.

By referring to FIGS. 1 and 2 of the drawings, it will be seen that the tamper-evident cap for containers disclosed herein has a top portion generally indicated at 10 and comprising a central thin walled portion 11 having a depending sealing flange 12 at its annular edge 13 and joining an integral relatively thicker annular portion 14, the peripheral portion of which joins a relatively thinner circumferential skirt 15. A pair of annular vertically spaced wide thickened flanges 16 and 17 are formed on the inner surface of the circumferential skirt 15 and a circumferential groove 18 is formed in the thin walled circumferential skirt 15 below the uppermost wide thickened flange 16. A relatively rigid circular flange 19 is formed on the outer surface of the thin walled circumferential skirt 15 and is provided with an annular gusset 20, the lower edge thereof being spaced slightly above the upper edge of the uppermost inturned thickened flange 16 as best seen in FIGS. 2 and 4 of the drawings. Flange 16 is band-shape with thick top edge.

By referring again to FIGS. 1 and 3 of the drawings, it will be seen that the circumferential groove 18 is shown in broken lines in FIG. 1 and a secondary groove 21 extends downwardly therefrom to the lower edge of the circumferential skirt 15 to a point adjacent a depending pull tab 22.

Figure 5:
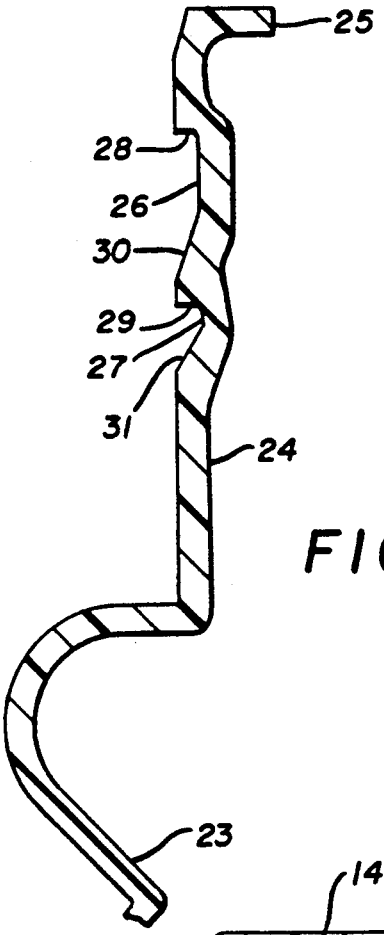
FIG. 5 is an enlarged section of the container neck of FIG. 2.

By referring now to FIGS. 1, 2, and 5 of the drawings, it will be seen that a top portion of a container 23 has an upwardly extending neck portion 24, the upper end of which defines an inturned horizontal flange 25. The exterior of the neck portion 24 comprises the finish thereof and defines a pair of vertically spaced grooves 26 and 27, the uppermost portion of each of the grooves 26 and 27 defining horizontal surfaces 28 and 29 respectively, with the innermost portion of each of the grooves defining a vertical surface and the lower portion of each of the grooves 26 and 27 angling downwardly and outwardly as at 30 and 31 respectively.

Figure 3:
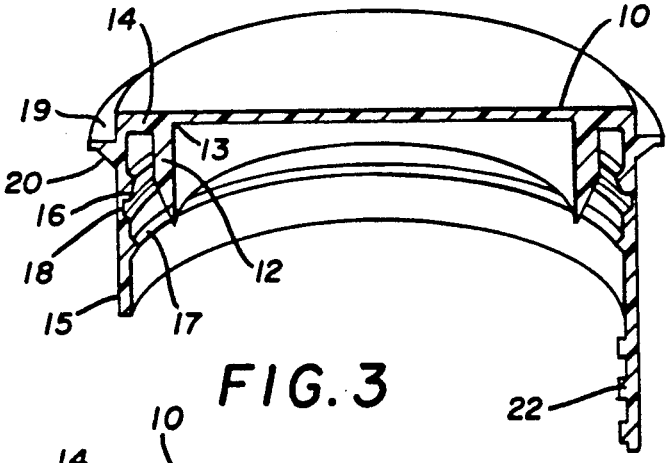
FIG. 3 is a perspective elevation with parts in cross section illustrating a vertical section of the tamper-evident cap on line 3—3 of FIG. 1.

Still referring to FIGS. 2, 3 and 5, it will be observed that the vertical surfaces of the grooves 26 and 27 respectively, are of different lengths, the vertical surface 26 of the groove being approximately the same dimension as the vertical height of the inturned relatively thick flange 16 on the inner surface of the thin walled circumferential skirt 15 of the tamper-evident cap. The flange 16 forms a band with a tapered surface.

By referring again to FIGS. 2 and 3 of the drawings, it will be seen that the uppermost surfaces of each of the inturned thickened flanges 16 and 17 on the circumferential thin walled skirt of the cap are angled downwardly and inwardly at approximately a 45° angle and that the grooves 26 and 27 in the finish of the neck portion 24 of the container 23 are as hereinbefore described horizontally disposed surfaces 28 and 29 respectively, so that installing the tamper-indicating cap of the invention on the neck 24 of the container 23 on which it is to be sealingly engaged is facilitated. The same surfaces comprise fastening configurations.

Still referring to the tamper-evident cap as illustrated in FIGS. 2, 3 and 4, it will be seen that there are a plurality of effective sealing surfaces in engagement with the finish on the neck portion 24 as best seen in FIG. 2 of the drawings.

By referring to FIG. 2 in particular, it will be observed that the inturned flange 25 on the upper end of the neck portion 24 sealingly engages the outer surface of the downturned sealing flange 12 and at the same time, the lower surface of the annular thickened portion 14 of the tamper evident cap engages the upper matching horizontal surface of the inturned flange 25 on the finish of the neck portion 24. It will be observed that this tight sealing registry of the inner end of the inturned flange 25 and its upper surface of the neck finish with the outer upper surface of the downturned sealing flange 12 and the annular thickened portion 14 of the tamper-evident cap, is caused by the downwardly angled configuration of the uppermost inturned thickened flange 16, which progressively urges the tamper-evident cap downwardly on the finish of the neck portion 24 as the tamper-evident cap is pushed downwardly thereon at the time of its original installation and in any resealing reapplication of the tamper-evident cap after it has been separated from the tear skirt portion of the circumferential skirt 15.

In addition to the aforementioned double sealing surfaces of the tamper-evident cap with respect to the inturned horizontal flange of the neck portion 24, there is a substantial vertical sealing surface immediately above the uppermost inturned thickened flange 16 with that portion of the finish of the neck portion 24 that extends vertically above the horizontal surface 28.

Still referring to FIG. 2 of the drawings, it will be seen that in addition to the above three sealing surfaces, which are continuously circular and both horizontal and vertical, another vertical sealing surface between the tamper-evident cap and the finish of the neck portion 24 of the container is formed between the inturned horizontal surface 29 of the groove 27 in the finish of the neck portion 24 and the registering vertical surface of the inner portion of the circumferential skirt 17 below the circumferential groove 18. There are thus four liquid sealing surfaces and annular points of contact between the tamper-evident cap of the invention and the finish of the neck portion 24 disclosed herein, although each of them has a relatively few fastening configurations, they act in cooperation with one another to insure effective liquid tight sealing of the several sealing surfaces. The same downward urging of the circumferential skirt 17 and its interior sealing surfaces hereinbefore described, occurs when the inwardly and downwardly angular surface of the inturned thickened flange 17 engages the outer corner of the horizontal surface 29 of the groove 27 in the neck finish.

At the same time, the interior and exterior configuration of the tamper-evident cap, see FIG. 4, is relatively easy to mold as an integral synthetic plastic tamper-evident cap from any one of the synthetic resins that are known in the art.

Figure 6:
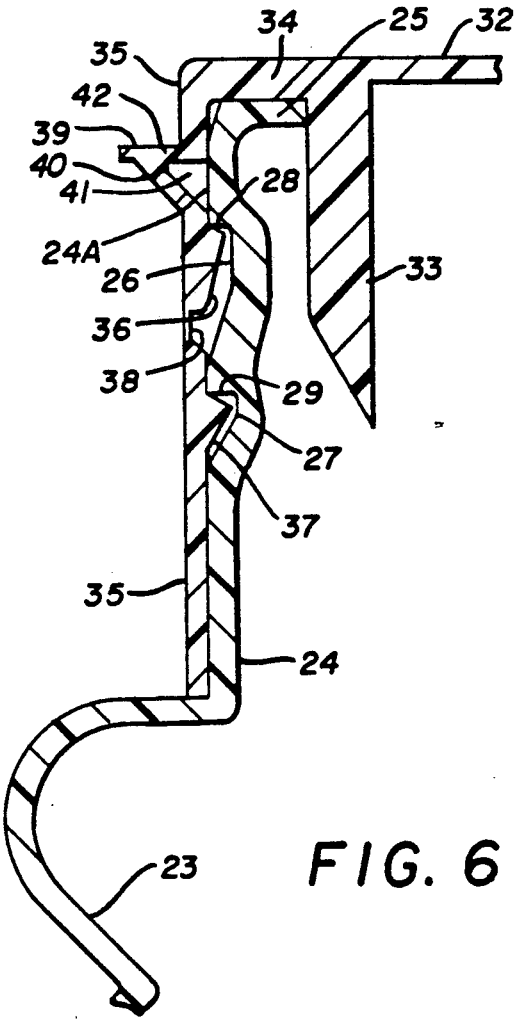
FIG. 6 is an enlarged section of a modified form of the tamper-evident cap positioned on a section of the container neck of FIG. 2.

By referring now to FIG. 6 of the drawings, a modification in the tamper-evident cap hereinbefore described, is illustrated and by referring to FIG. 6, it will be seen that the illustration includes the container 23 with its substantially cylindrical neck portion 24, the upper end of the neck portion having the inturned horizontal annular flange 25 and the neck finish having the vertically spaced grooves 26 and 27.

It will also be seen that the tamper-evident cap as modified comprises a central thin walled top portion 32 having a downturned sealing flange 33 which is integrally formed therewith and with an annular relatively thicker top portion 34 from which a depending circumferential skirt 35 is formed. There are vertically spaced relatively thicker inturned flanges or bands 36 and 37 and an annular groove 38 therebetween defines an annular area of weakness or a tear line. An outturned relatively rigid circular flange 39 extends annularly around the tamper-evident cap and it has a gusset 40 integral therewith therebelow. The modification comprises the formation of an annular semi-triangular cavity 41 in the thin walled circumferential skirt 35, the cavity 41 extending substantially into the gusset 40 and forming a live hinge at 42 in the innermost portion of the relatively rigid circular flange 39. The modified tamper-evident cap fits securely and in liquid sealing relation to the cylindrical neck portion 24 and its fastening configurations comprising the grooves 26 and 27 and their horizontal shoulder surfaces 28 and 28 respectively, and has increased the number of liquid sealing surfaces as follows: the first being the contact between the upper outer portion of the downturned sealing flange 33 of the cap with the inner vertical surface of the horizontal inturned flange 25 of the cylindrical neck portion 24; the second being the sealing engagement between the lower surface of the thickened annular portion 34 of the cap and the upper surface of the inturned annular flange 25 of the neck finish 24; the third being the annular sealing engagement between the inner surface of the thin walled circumferential skirt 35 above the annular semi-triangular cavity 41 and the vertical smooth cylindrical surface 24A of the portion 24 of the container 23. The fourth sealing surface comprises the annular engagement of the inner smooth vertical surface of the thin walled circumferential skirt 35 immediately above the upper surface of the relatively thickened annular flange or band 36 and the smooth vertical surface 24A of the neck 24 of the container 23; the fifth point of annular sealing comprises that between the annular smooth inner surface of the circumferential skirt 35 immediately above the thickened flange 37. Although not shown in FIG. 6, the circumferential skirt 35 is provided with a duplicate of the tab 22 and its tear-away adjoining configuration like that in the hereinbefore described and illustrated embodiments of the invention.

The modification of FIG. 6 has the further advantage over that of the heretofore described form of the invention in that different densities of synthetic resin may be employed with minor differences in the thickness of the corresponding portions of the tamper-evident cap due to the presence of the live hinge 42 which permits the relatively rigid circular flange 39 and the uppermost relatively thickened inturned flange 36 to more readily be pressed downwardly onto the neck finish of a container, such as a blow molded plastic bottle, while at the same time providing convenient finger holds for removing the closure when the tear skirt portion of the circumferential skirt 35 has been removed, as hereinbefore described.

Figure 7:
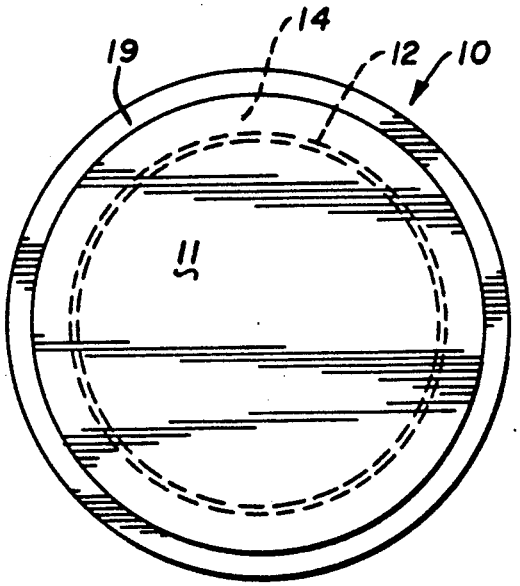
FIG. 7 is a top plan view of the container cap of FIG. 1 in enlarged detail.

By referring now to FIG. 7 of the drawings, it will be seen that broken lines illustrate the position of the downturned sealing flange 12 of the tamper-evident cap and the area of the central thin walled portion 11 as well as the area of the annular relatively thickened portion 14.

By referring now to FIG. 8 of the drawings, the form of the tamper-evident cap heretofore disclosed and described in connection with FIGS. 1, 2, 3 and 4 has been repeated and the tamper-evident cap is shown illustrated on a different cylindrical neck portion 44 of a blow molded plastic container 45 which neck finish has different fastening configurations than that of the cylindrical neck portion 24 hereinbefore described and illustrated.

Figure 8:
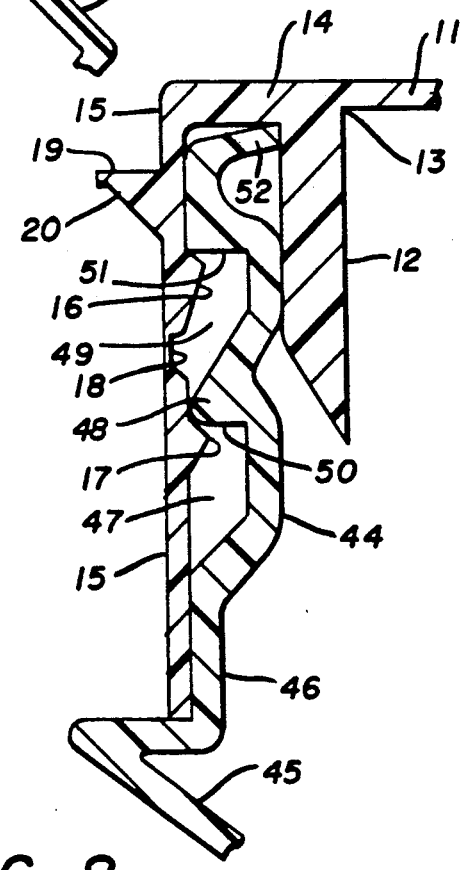
FIG. 8 is an enlarged detail of a portion of the tamper-evident cap of FIGS. 2, 3 and 4 engaged on a different container neck, such as available in the market.

In FIG. 8, the finish on the neck portion 44 includes a first vertical portion 46, a deep inwardly extending relatively wide groove 47, a sharply outturned rib 48, the upper surface of which angles upwardly and inwardly in forming immediately a second inturned groove 49. Both the lower groove 47 and the upper groove 49 have horizontal inturned surfaces 50 and 51 respectively, and the uppermost portion of the modified neck portion 44 is formed of an inturned upwardly and inwardly angled annular flange 51. The tamper-evident cap is the same as in FIGS. 1,2,3 and 4 hereinbefore described and comprises a central thin walled portion 11, a downturned sealing flange 12, a thickened annular portion 14 from which a thin walled circumferential skirt 15 depends. The interior of the otherwise smooth vertical surface has the pair of relatively thickened flanges or bands 16 and 17 and the circumferential groove 18 forming an area of weakness circumferentially of the cap is disposed therebetween. The exterior of the thin walled circumferential skirt 15 carries the relatively rigid circular flange 19 with its integral gusset 20.

It will be observed that the container neck portion 46 as illustrated in FIG. 8 is one that is widely available in the dairy industry and that the tamper-evident cap of the present disclosure and both of its forms disclosed sealingly engages the modified and substantially changed container neck portion and the finish thereon.

It will also be seen that the formation of the top portion 10 of the preferred embodiment of the invention as a thin wall section relative to a thick annular horizontal peripheral edge portion 14 with the spaced thicker depending sealing flange 12 and the circumferential skirt 15 upper portion and its outturned annular relative rigid flange 19 and the thickened wide flange or band 16 define an inverted U-shaped peripheral edge which acts as a circular clamp when pressed on the neck of the container.

Having thus described my invention, what I claim is:

1. In a plastic tamper-evident cap of the type having a top, a thin walled circumferential skirt depending from said top, a sealing flange depending from said top spaced inward from said skirt, a pair of wide inwardly extending annular flanges formed on the inner surface of said skirt in vertically spaced relation to one another, a circumferential groove in said inner surface of said skirt between said wide flanges, a tab integrally formed with said circumferential skirt depending therefrom, and a second groove extending from said circumferential groove to the bottom edge of said circumferential skirt adjacent said tab;

the improvement which comprises an outturned rigid annular flange on the exterior of said circumferential skirt below said top and above the uppermost of said inturned wide flanges, said top having a thin walled central portion and a relatively thicker annular peripheral portion between said sealing flange and said skirt.

2. The plastic tamper-evident cap of claim 1 wherein said outturned rigid annular flange has a substantially horizontal top surface, a short, substantially vertical outer edge, a short, substantially horizontal under-surface adjacent said outer edge and a downward-inward slanted surface extending from said horizontal under-surface to merge with the outer surface of said circumferential skirt.

3. The plastic tamper-evident cap of claim 1 wherein said thin walled central portion of said cap is of a known thickness and said thin walled circumferential skirt is of substantially the same thickness as said central portion.

4. The plastic tamper-evident cap of claim 1 and wherein said uppermost one of said inwardly extending flanges takes the form of a band having a thick upper edge and tapers downward and outward to the bottom edge thereof and said bottom edge defines the upper surface of said circumferential groove in said thin walled circumferential skirt.

5. The plastic tamper-evident cap of claim 1 wherein said outturned rigid annular flange is of approximately triangular cross sectional shape with the apex of the triangular shape directed outwardly of said circumferential skirt and defines an annular cavity in the inner surface of said thin walled circumferential skirt so as to form a live hinge at the corner of the upper surface of said outturned rigid annular flange and said thin walled circumferential skirt.

6. A plastic tamper-evident cap having a top with an inverted U-shaped peripheral portion consisting of an annular horizontal portion, a circumferential skirt thereon, an outturned annular flange on said skirt below said horizontal portion, a wide inturned flange on the interior of said circumferential skirt below said annular flange and an annular sealing flange depending from said top inwardly of said skirt, said annular horizontal portion and said annular sealing flange being relatively thick walled with respect to said top so as to forcefully engage a neck portion of a container positioned between said sealing flange and circumferential skirt and against said annular horizontal portion of said top, an annular groove in said circumferential skirt below said wide inturned flange forming a tear line by which a lower portion of said skirt may be removed from said cap.

* * * * *